US005678714A

United States Patent [19]

Guglielmini

[11] Patent Number: 5,678,714

[45] Date of Patent: Oct. 21, 1997

[54] TAMPER INDICATING SCREW TYPE CAP

[75] Inventor: Bernard Guglielmini, Crinolois, France

[73] Assignee: Rical, France

[21] Appl. No.: 421,790

[22] Filed: Apr. 14, 1995

[30] Foreign Application Priority Data

Apr. 15, 1994 [FR] France ..... 94 04821

[51] Int. Cl.[6] ..... B65D 41/34

[52] U.S. Cl. ..... 215/252; 215/258

[58] Field of Search ..... 215/252, 253, 215/254, 256, 258, 329, 330, 331

[56] References Cited

U.S. PATENT DOCUMENTS

| | | | |
|---|---|---|---|
| 4,147,268 | 4/1979 | Patel et al. | 215/253 X |
| 4,394,918 | 7/1983 | Grussen | 215/253 X |
| 4,458,822 | 7/1984 | Ostrowsky . | |
| 4,470,513 | 9/1984 | Ostrowsky | 215/252 |
| 4,657,153 | 4/1987 | Hayes . | |
| 4,744,479 | 5/1988 | Schottli | 215/252 |
| 4,801,031 | 1/1989 | Barriac . | |
| 4,978,016 | 12/1990 | Hayes . | |
| 5,147,053 | 9/1992 | Friedenthal | 215/254 X |

FOREIGN PATENT DOCUMENTS

| | | |
|---|---|---|
| 92884 | 11/1983 | European Pat. Off. . |
| 2269372 | 2/1994 | United Kingdom . |
| WO 92/13773 | 8/1992 | WIPO . |

*Primary Examiner*—Allan N. Shoap
*Assistant Examiner*—Nathan Newhouse

[57] ABSTRACT

A tamper-indicating screw-on closure cap for receptacles having threaded necks includes a tamper-indicating security band in the form of a ring including a stop strip turned inwardly of the ring and inclined in an inward and upward direction so that, upon first assembly of the cap to a receptacle neck the stop strip engages beneath a peripheral projection on the neck. The stop strip includes a continuous upper edge lying in an imaginary stop plane extending perpendicular to the axial direction of the cap and spaced zones of lesser thickness that define a plurality of sectors that also include an inwardly projecting chordwise rib terminating at an inner edge that subtends each respective sector, wherein the edges of the ribs together define a polygonal section of passage the inscribed circle of which presents a diameter smaller than that of the peripheral projection of the neck.

12 Claims, 4 Drawing Sheets

TAMPER INDICATING SCREW TYPE CAP

FIELD OF THE INVENTION

The present invention relates to tamper indicating screw-on stopper or closure caps conventionally used for hermetically closing receptacles, such as bottles, and whose necks comprise cooperation means complementary of the cap to allow screw-action placement and removal.

The invention relates more particularly to caps manufactured by moulding, of semi-rigid plastics material, and more specifically to caps which are provided with a means guaranteeing security and proving to the user that the receptacle had not been tampered with before the user has first opened it.

BACKGROUND OF THE INVENTION

Caps of the above type generally comprise a top bordered by a substantially cylindrical skirt, provided on its inner face with a helicoidal thread adapted to cooperate with a complementary thread on the neck of a receptacle.

The base of the skin is extended by a security ("tamper-indicating") ring or band joined to the skirt by bridges of low tensile strength.

The security ring comprises, from its base and in the direction of the inner peripheral surface, a so-called stop strip intended to abut beneath a projection of the neck of the receptacle in the assembled and closed position.

When the cap is first opened by unscrewing, the stop strip remains immobilized by the projection on the neck of the receptacle, which causes rupture of the breakable bridges, making it possible to remove the cap, while leaving the security ring behind on the neck.

The prior an has proposed numerous embodiments for manufacturing such a cap provided with a security ring. It may be considered that there are two main families or types of security rings in the prior art.

The first comprises, as stop strip, a plurality of inwardly folded petals.

In the second group, the stop strip is continuous.

It may be reckoned upon that the capsules of the second family present a better safety guarantee, being given that the continuous strip is, by nature, less subject to unwinding upon opening compared to the petals whose smaller section and greater flexibility constitute a risk of malfunctioning when first opened.

The object of the present invention envisages more particularly the capsules of the second family which may be illustrated in particular by European Patent 0 200 293.

In order to manufacture a capsule of the above type, it is necessary to effect moulding so that the continuous stop strip is inflected in an inclined manner but outwardly, so as to allow demoulding. To make such a capsule, it is then necessary to use relatively complex moulds employing mobile cores or sliding blocks responsible for the formation of the continuous strip and adapted to be at least relatively retractable to allow the manufactured capsule to be extracted.

In a second step, it is then necessary to inflect the continuous strip inwardly of the capsule, proceeding for example by rolling, so that, after the first placement on a receptacle, it can act by abutment, coming into place beneath the projection of the neck of the receptacle.

It will be appreciated that the above requirements lead to high manufacturing costs due to the necessity of employing a complex mould and to the existence of a supplementary step of reforming for the internal inflection of the strip having to be carried out with precision in order to guarantee reliability of the turn or inflection of the continuous stop strip.

The cost is all the higher as these two manufacturing requirements considerably reduce the possibility of mass-production which is one of the factors enabling low production costs to be obtained.

It is precisely an object of the present invention to overcome the drawbacks set forth hereinabove, by proposing a novel screw-on cap incorporating a continuous security band or ring, which may be manufactured without requiring a reforming operation for turning or inflecting the continuous stop strip towards the inside, as is required by the presently known means employed.

SUMMARY OF THE INVENTION

To attain the objects set forth hereinabove, the cap according to the invention is characterized in that the stop strip of the ring

- presents a continuous upper end edge defining a stop plane at right angles to the axis of the cap,
- comprises in certain locations zones of lesser thickness defining in the band a plurality of sectors,
- is provided, for each sector and over its inner peripheral face with respect to said axis, with a rib presenting an edge which subtends said sector, said edges together defining a polygonal section of passage the inscribed circle of which presents a diameter smaller than that of the larger circle of the neck.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
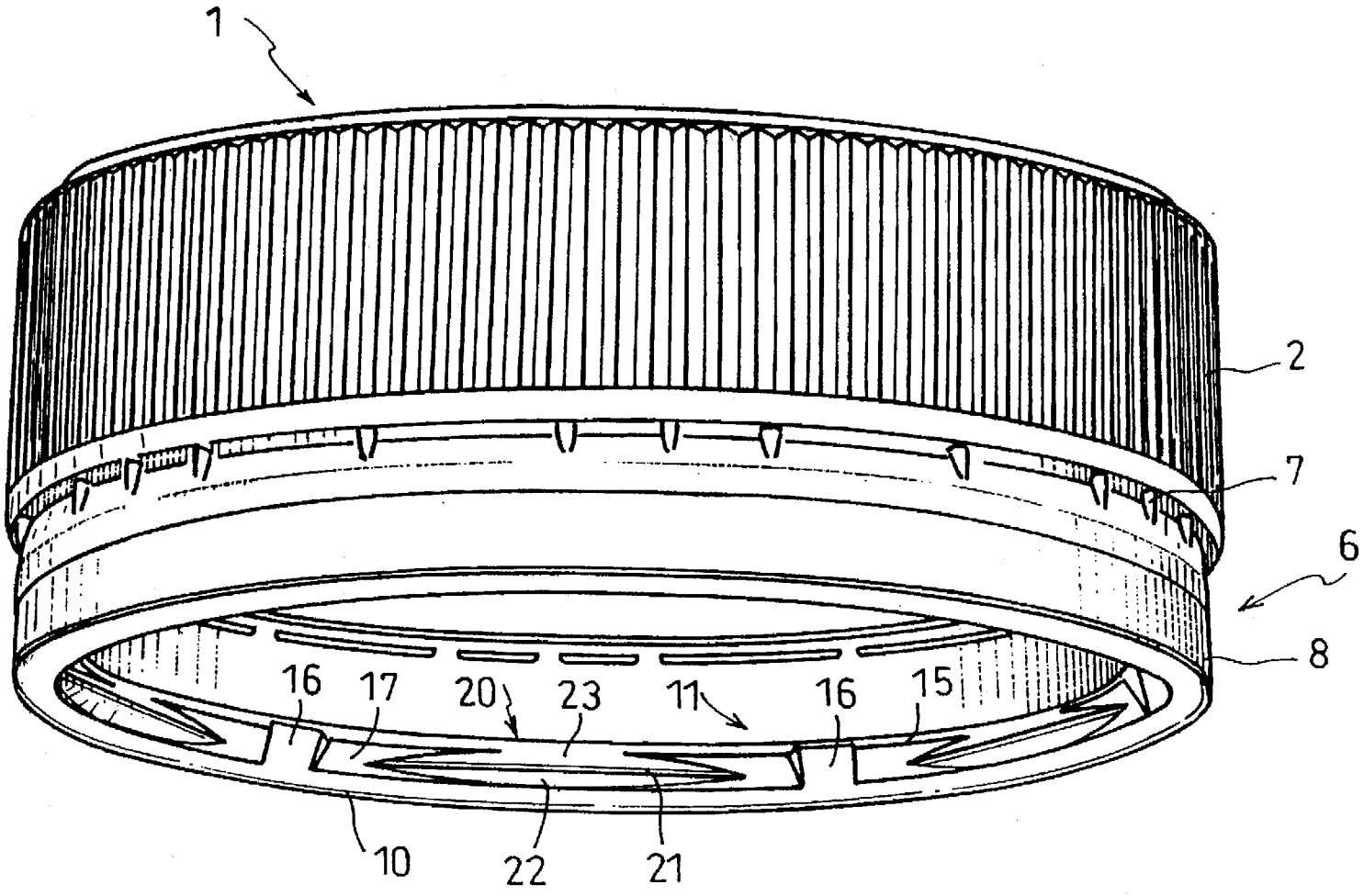
FIG. 1 is a view in perspective of a cap according to the invention.
Figure 2:
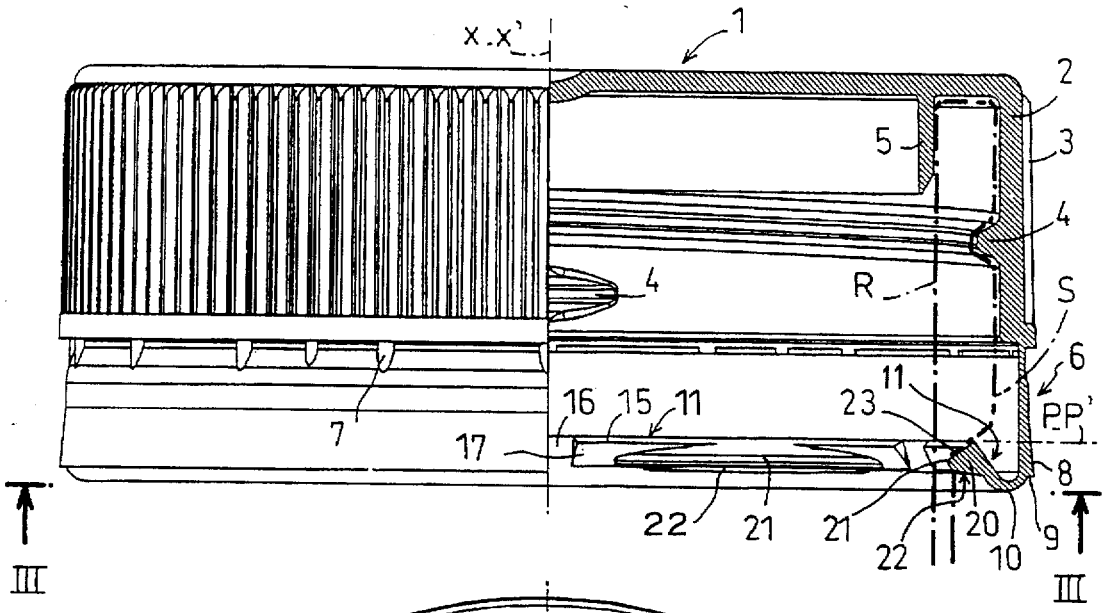
FIG. 2 is a half-section/half-elevation, on a smaller scale, of the cap according to FIG. 1.

Referring now to the drawings, FIGS. 1 and 2 show the screw-on cap according to the invention comprising a top 1 bordered by a substantially circular skirt 2, provided on the outside with means 3 for facilitating manipulation thereof. Means 3 may be constituted for example by flutings or the like extending in the axial direction.

The skirt 2 bears on its inner peripheral face means 4 for mounting by screwing and removal by unscrewing on the neck of a receptacle R which comprises, in conventional manner, elements of shape complementary to that of means 4. By way of example, means 4 may be constituted by one or more continuous or discontinuous helicoidal threads.

The inner face of the top 1 may be equipped with an added seal or possibly be provided with a circular lip 5 intended to penetrate inside the neck to ensure, alone or in combination with a seal, tightness in the closed position of the cap.

The above cap is made by moulding in one operation from an appropriate raw material, particularly a thermoplastic polymer such as polyolefin type, for example.

According to a known arrangement, the base of the skirt 2 is extended by a security ring 6, moulded therewith, which is joined to the base of the skirt by breakable bridges 7 presenting a low tensile strength.

The security ring 6 comprises a band 8 whose base 9 is extended, beyond a connecting fold 10, by a continuous stop strip 11 which is inflected in an inclined manner towards the inside of the capsule and in the direction of the top 1.

According to the invention, the strip 11 is made to comprise a continuous upper end edge 15 defining a stop plane P–P' which is at right angles to the axis X–X' of revolution of the skirt 2. The continuous upper end edge 15 is intended to engage and abut beneath the continuous or discontinuous peripheral projection S presented on the outside by the neck of a receptacle R (partially shown in broken lines), when the cap 2 is mounted thereon. Such a cooperation is known in the art and, for this reason, it is simply represented in broken lines in FIG. 2.

The strip 11, within the framework of the invention, further comprises, in selected locations, zones 16 of lesser thickness, but of a non-breakable nature, the presence of which has for its effect to define in the strip 11 a plurality of sectors 17 generally covering the same angular range. Each zone 16 is preferably made in the form of a notch, of generally axial direction, presenting a depth which increases in the direction of edge 15, so as to be substantially flush therewith, as illustrated more particularly in FIGS. 1 and 4. Each notch 16 preferably originates substantially from the fold of connection 10, and extends over the whole useful height of the strip 11.

Figure 3:
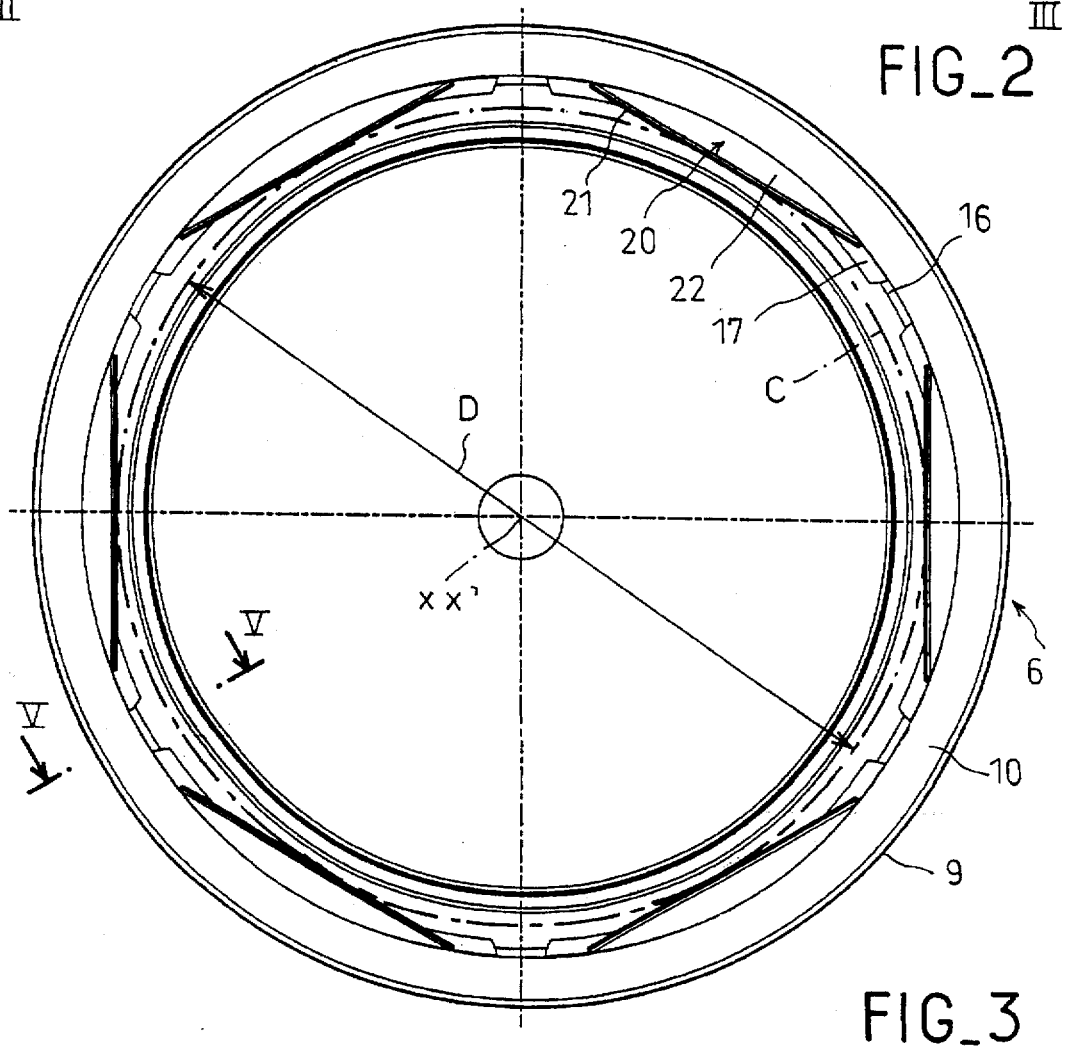
FIG. 3 is a plan view taken along line III—III of FIG. 2.

In the example shown in FIG. 3, the strip 11 comprises six notches 16 which define six sectors 17 therebetween in the strip 11. Such an embodiment is given only by way of illustration as, depending on the calibers or diameters of cap, it may be contemplated to reduce or increase the number of notches 16.

According to another characteristic of the invention, the strip 11 is made by moulding, so that each sector 17 is provided, on its inner peripheral face with respect to axis x–x', with a generally chordwise rib 20 in crescent form which present an edge 21 subtending the sector 17. Each edge 21 is preferably rectilinear and is disposed in a plane which is included between plane P–P' and the connecting fold 10.

The different ribs 20 thus define by their edges 21 a polygonal section more particularly illustrated in FIG. 3 and of which the inscribed circle C presents a diameter D which is smaller than the larger diameter of the peripheral projections of the neck of the receptacle.

Figure 4:
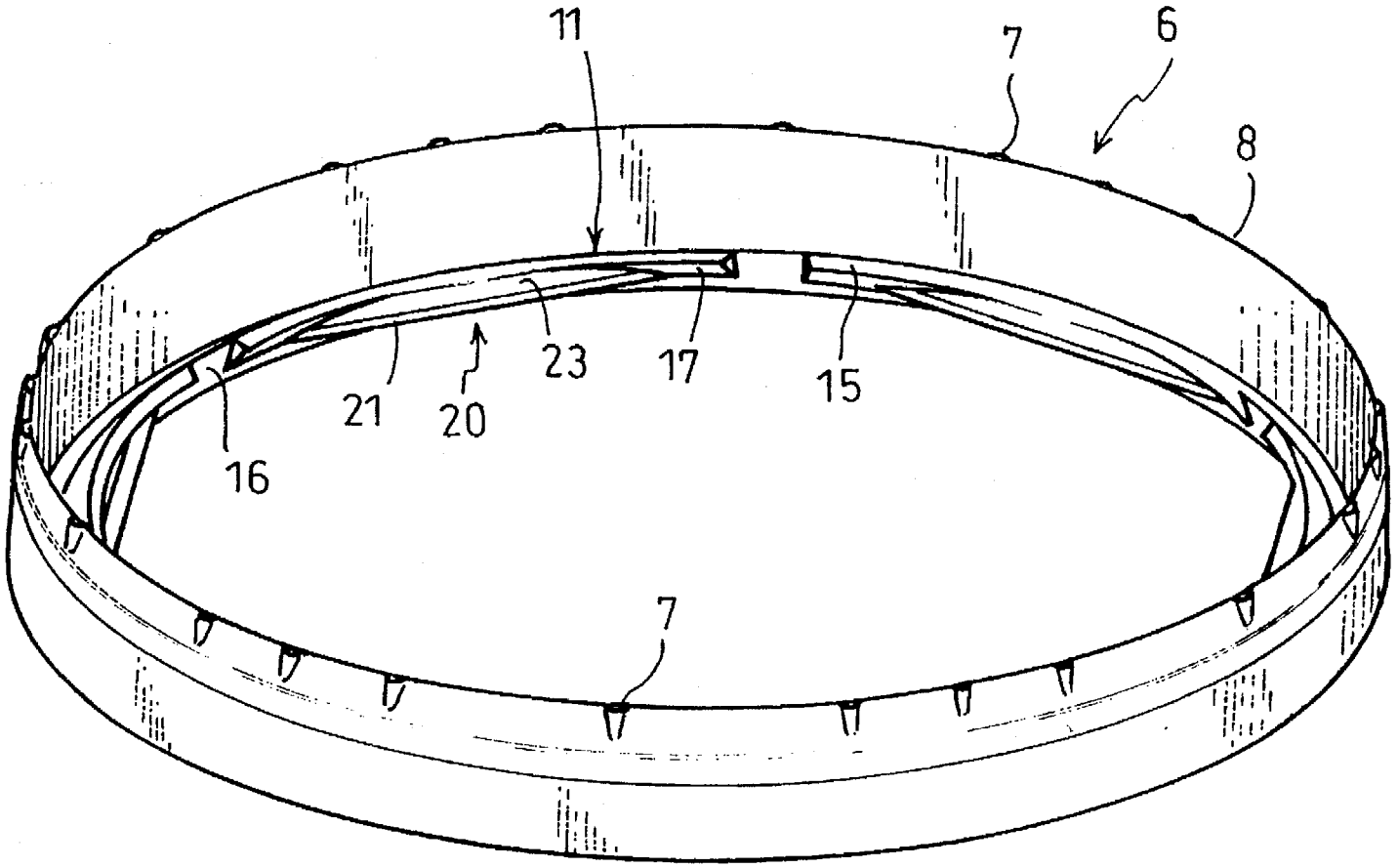
FIG. 4 is a view in perspective, on a larger scale, of the security band separated from the cap in order to show more precisely the constructive characteristics.
Figure 5:
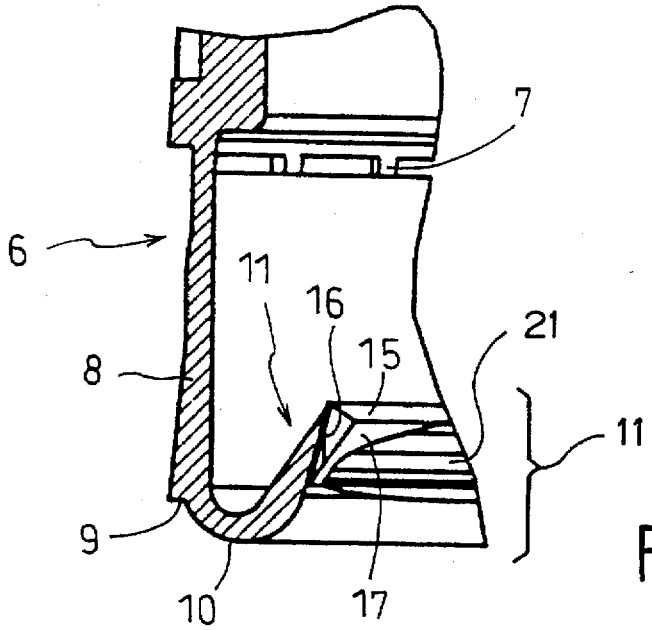
FIG. 5 is a partial section, taken, on a larger scale, along line V—V of FIG. 3.

According to another arrangement, the edge 21 of each rib 20 is joined to the inner face of the sector 17 by a face 22 and to the continuous edge 15 by a face 23. FIGS. 1, 2 and 4 clearly show that the face 23 is curved and made so as to be flush, in its median part, with the edge 15.

The object of the strip 11 according to the invention and as described hereinabove is to form a continuous band constituted by successive sectors of relatively rigid nature and which are joined together by the zones whose lesser thickness has two functions.

The first of the functions is to react or withstand tensile or compressive stress which makes it possible to mould the strip 11 in the desired final configuration, as illustrated by the drawings, and to demould the capsule obtained by ejection and axial thrust with flexible deformation of the strip to facilitate ejection with respect to the core of the mould.

The second function is to give the strip a sort of memory of shape which makes it possible, after the stretching stress imposed during the demoulding phase, to automatically return the strip 11 into its inwardly inflected position, which is the one conferred thereto so as to cooperate with the projection of the neck, as shown in FIG. 2.

If the faculty of absorbing a tensile or compressive stress during demoulding is of interest to facilitate manufacture and eliminate the operation of reforming and internal rolling, as is known, such a faculty is of double interest upon assembly of the cap for the first closure of the receptacle neck.

In fact, as circle C is of diameter D smaller than that of the neck, the first stopping involves exerting an axial stress to fit the cap on the neck of the receptacle.

The presence of the (discontinuous) edges 21 reduces the friction at the point of contact of each with the periphery of the neck and ensures, by axial stress, a fit of the cap which is facilitated by the faculty of inward flexion of the strip 11 allowed by the presence of the notches 16.

When fit is effected, the strip 11, via the notches 16, restores the effort stored by the stretching stress undergone, with the result that, by memory of shape, it tends to readopt its original stable position in which the edge 15 is returned beneath the projection S of the neck of the receptacle, as illustrated in FIG. 2.

In this position, abutment is ensured by the continuous inner edge 15 but also by the faces 23 of each of the ribs 20.

The possibility of manufacturing the stop strip 11 directly in its functional position or configuration, enables the usual reforming phase to be eliminated and consequently to increase the manufacturing rate, to increase the number of impressions which may be made in a mould by reason of the absence of the slide blocks necessary for moulding the strips in a conventional manner and to be able consequently to produce stopping caps at a cost price lower than that of the present cap.

The constructive arrangements employed also make it possible to obtain a security band 6 presenting high operational safety, due principally to the existence of the continuous edge 15 and to the presence of the ribs 20 whose upper faces 23 provide a firm, resistant abutment. Furthermore, the presence of the ribs 20 opposes any risk of unwinding of the strip 11 on the fold 10 when the cap is unscrewed, with the result that, by the abutment produced, an efficient rupture of the bridges 7 occurs at the first action of unscrewing imposed on the cap.

The user is thus assured an essential safety or tamper indicating factor.

Another advantage is also provided by the fact that the ribs 20, due to the presence of the edges 21 and the faces 22, which respectively limit the surface contact and constitute sorts of ramps for engagement, ensure an automatic assembly of the capsule without employing means which develop a considerable axial thrust requiring a significant energy consumption.

Figure 6:
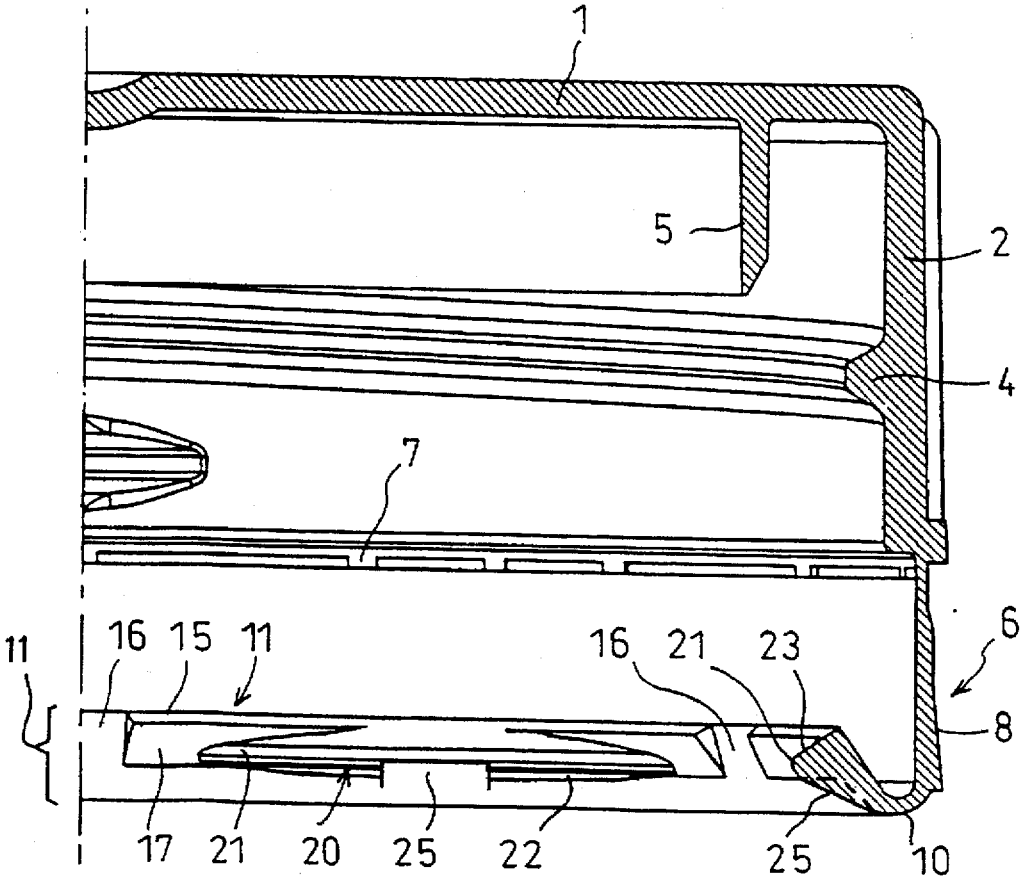
FIG. 6 is a partial section/elevation illustrating a variant embodiment of the cap of the invention.

To that end, in accordance with a variant embodiment illustrated in FIG. 6, an inclined ramp 25 may be provided, during moulding, for each rib 20, which substantially joins the fold 10 to the edge 21, constituting a sort of projection presented locally by face 22.

In this way, engagement upon first assembly is facilitated by the definition of a sort of cone for introduction and slide presented by the different ramps 25 on which the opening of the neck initially abuts.

The invention is not limited to the embodiments described and shown, as various modifications may be made thereto without departing from its scope.

What is claimed is:

1. A tamper-indicating screw-on closure cap for receptacles having threaded necks including peripheral projections, said cap comprising:

a top;

a cylindrical skirt extending axially from the top, the skirt having a tamper-indicating security band extending from and connected to the skirt by rupturable bridges;

said security band comprising a ring associated with a continuous stop strip turned inwardly of the ring and skirt so as to extend in an upwardly and inwardly rising and inclined direction, whereby, upon first assembly of the cap to a receptacle neck, the stop strip engages beneath a peripheral projection of said neck;

said stop strip comprising a base connected to the ring and a continuous upper edge lying in an imaginary stop plane extending normal to the axial direction of the cap; a plurality of sectors located at spaced locations along the stop strip, said sectors defined and separated by generally axially extending notches in the strip of lesser axial thickness than the stop strip, said notches each having a depth that increases in the direction from the base of the strip towards the upper edge of the strip; each sector having an inner face and including on the inner face a generally chordwise extending rib presenting an inner edge that subtends said sectors; the inner edges of the ribs collectively defining a polygonal section of passage the inscribed circle which presents a diameter that is smaller than the neck peripheral projection.

2. A screw-on cap according to claim 1, wherein each notch originates at the base of the strip, and said base is connected to the ring by a fold.

3. A screw-on cap according to claim 1, wherein each rib is substantially crescent-shaped with a convex side thereof located at the outer edge of each rib and with the inner edge of each rib lying between the base of the respective sector and the stop plane.

4. A screw-on cap according to claim 1 or 3, wherein each rib is connected to an inner peripheral surface of each associated respective sector by a curved upper face the apex of which is flush, with the upper edge of the respective sector.

5. A tamper-indicating screw-on closure cap for receptacles having threaded necks including peripheral projections, said cap comprising:

a top;

a substantially cylindrical skirt extending axially from the top, the skirt having a tamper-indicating security band extending from and connected to the skirt by rupturable bridges;

said security band comprising a ring associated with a continuous stop strip turned inwardly of the ring and skirt so as to extend in an upwardly and inwardly rising and inclined direction, whereby, upon first assembly of the cap to a receptacle neck, the stop strip engages beneath a peripheral projection of said neck;

said stop strip comprising a base connected to the ring and a continuous upper edge lying in an imaginary stop plane extending normal to the axial direction of the cap; a plurality of sectors located at spaced locations along the stop strip, said sectors defined and separated by zones of lesser thickness of the stop strip; each sector having an inner face and including on the inner face a generally chordwise extending rib presenting an inner edge that subtends said sector; each sector connected to the ring at the base by a fold; the inner edges of the ribs collectively defining a polygonal section of passage the inscribed circle of which presents a diameter that is smaller than a neck peripheral projection; each rib being connected to the fold between its respective sector and the ring by an inclined plane face.

6. A screw-on cap according to claim 5, wherein the inclined plane face includes at least one projection defining an inclined ramp extending from the fold to the inner edge of the rib.

7. A screw-on cap according to claim 5, wherein each rib is substantially crescent-shaped with a convex side thereof located at the outer edge of each rib and with the inner edge of each rib lying between the base of the respective sector and the stop plane.

8. A screw-on cap according to claim 7, wherein the inclined plane face includes at least one projection defining an inclined ramp extending from the fold to the inner edge of the rib.

9. A screw-on cap according to claim 5, wherein each rib is connected to an inner peripheral surface of each associated respective sector by a curved upper face the apex of which is flush with the upper edge of the respective sector.

10. A screw-on cap according to claim 9, wherein the inclined plane face includes at least one projection defining an inclined ramp extending from the fold to the inner edge of the rib.

11. A screw-on cap according to claim 5, wherein each rib is substantially crescent-shaped with a convex side thereof located at the outer edge of each rib and with the inner edge of each rib lies between the base of the respective sector and the stop plane; and wherein each rib is connected to an inner peripheral surface of each associated respective sector by a curved upper face the apex of which is flush with the upper edge of the respective sector.

12. A screw-on cap according to claim 11, wherein the inclined plane face includes at least one projection defining an inclined ramp extending from the fold to the inner edge of the rib.

* * * * *